US008256915B2

(12) United States Patent
Stern et al.

(10) Patent No.: US 8,256,915 B2
(45) Date of Patent: Sep. 4, 2012

(54) ILLUMINATED MIRROR WITH COMFORT AUGMENTATION

(76) Inventors: Gary Stern, San Diego, CA (US); Patricia Stern, San Diego, CA (US)

( * ) Notice: Subject to any disclaimer, the term of this patent is extended or adjusted under 35 U.S.C. 154(b) by 130 days.

(21) Appl. No.: 12/267,588

(22) Filed: Nov. 8, 2008

(65) Prior Publication Data

US 2010/0118520 A1 May 13, 2010

Related U.S. Application Data

(60) Provisional application No. 61/129,201, filed on Jun. 11, 2008.

(51) Int. Cl.
*F21V 33/00* (2006.01)

(52) U.S. Cl. ..... 362/135; 362/253

(58) Field of Classification Search ..... 362/136, 362/140–144
See application file for complete search history.

(56) References Cited

U.S. PATENT DOCUMENTS 3,435,199 A * 3/1969 Ely ..... 362/141
3,772,508 A * 11/1973 Zapater et al. ..... 34/88
4,701,594 A * 10/1987 Powell ..... 219/219
5,997,149 A * 12/1999 Chu ..... 362/142
6,095,671 A * 8/2000 Hutain ..... 362/373
2010/0073792 A1* 3/2010 Limjoco ..... 359/877

OTHER PUBLICATIONS

Specifications for Orion Fans model OD8025 DC fan as obtained through the Digi-Key Corporation (www.digikey.com).*

* cited by examiner

*Primary Examiner* — Jong-Suk (James) Lee
*Assistant Examiner* — Leah S Macchiarolo
(74) *Attorney, Agent, or Firm* — John K. Buche; Buche & Associates, P.C.

(57) ABSTRACT

An illuminated mirror includes a central reflective mirror portion and a surrounding transmissive portion supported to a housing. Spacing between an outer diameter of the transmissive portion and the housing allows airflow to exit from the housing. A chamber behind the mirror surface may comprise a dish reflector surface. In one form, the dish reflector comprises a white enamel surface. Lamps, which may comprise LEDs, are mounted to the reflector surface. The LED lamps may be placed in a pattern on the reflector surface. Circuitry may be provided to illuminate either all or selected ones of the LEDs. Lamps of selected colors may be provided. Preselected combinations of lamp illumination vary the level and composite color of illumination. In order to enhance the comfort of a user, a fan may be positioned in the housing behind the reflector. A cooling device may cool airflow from the fan.

18 Claims, 6 Drawing Sheets

ILLUMINATED MIRROR WITH COMFORT AUGMENTATION

CROSS-REFERENCE TO RELATED APPLICATIONS

The present utility application claims priority from U.S. provisional patent application No. 61/129,201 entitled "Illuminated Mirror With Comfort Augmentation" and filed on Jun. 11, 2008.

STATEMENT REGARDING FEDERALLY SPONSORED RESEARCH OR DEVELOPMENT

Not applicable.

BACKGROUND OF THE INVENTION

1. Field of Invention

The present subject matter relates generally to illuminated mirrors, often referred to as makeup mirrors, and more particularly to such assemblies capable of enhancing user comfort.

2. Related Art

A widely used form of mirror comprises a specular surface surrounded by a light source which illuminates a user. In one common prior art form, a circular mirror is surrounded by a transparent or translucent ring. Various forms of illumination have been provided to transmit light through the ring.

For example, U.S. Pat. No. 7,048,406 discloses a mirror device having one or more light devices disposed behind a mirror. A chamber is placed behind a mirror surface with a surrounding transmissive ring. This is referred to as a backlighted mirror. The light source may comprise incandescent lamps or light emitting diodes (LEDs).

U.S. Pat. No. 5,997,149 discloses a reversible, backlit grooming mirror with a planar mirror and a concave mirror mounted back-to-back in a reflector unit having a space between the mirrors. A light source is disposed in the space between the mirrors. The reflector unit is rotatable to present the planar mirror or the concave mirror to a user. The light source may comprise a halogen lamp. While halogen lamps provide strong illumination, they also generate more heat than other forms of lamps. This is a common cause of discomfort to users of makeup mirrors.

U.S. Pat. No. 6,533,433 discloses an illuminated mirror that includes a light that can be dimmed as desired by operating a dimmer switch on a base unit. This adjustment is primarily directed to incandescent lighting. While LEDs can be dimmed, the requisite circuitry is expensive.

U.S. Pat. No. 6,604,836 to Carlucci, et al. discloses an illuminated mirror that has a first light source of a first color and a second light source of a second color, a reflective surface adapted to be illuminated by the light sources, and a switch. The switch selectively energizes selected bulbs or all bulbs to simulate home light, office light or daylight. Versatility of color adjustment is limited since the incandescent lamps are located in corners of a box-like frame.

SUMMARY OF THE INVENTION

The present subject matter comprises an illuminated mirror in which a specular surface is supported to a housing and is circumscribed by a transmissive portion. Spacing peripheral to an outer perimeter of the transmissive portion, and limited by the housing, allows airflow to exit from the housing. The specular surface may be planar or concave (a convex surface could be provided but would be of lesser utility). The specular portion may be circular, and the surrounding transmissive portion may be annular and concentric with the central specular portion. A chamber behind the specular surface may comprise a reflector surface. In one form, the reflector surface comprises a white enamel surface. Lighting units may be mounted to the reflector surface.

In one form, the lighting unit is an LED illuminator which is substantially flat and comprises a plurality of individual LEDs in a row or other relative disposition. The LED illuminators may be placed in a pattern on the reflector surface. Circuitry may be provided to illuminate either all or selected ones of the LEDs. Preselected combinations of lamps may be illuminated or made to vary the level and composite color of illumination. In order to enhance the comfort of a user, a fan may be positioned in the housing behind the specular or reflector surfaces, whereby air is discharged from said spacing peripherally relative to said specular surface. A cooling device may be utilized to cool airflow from the fan.

BRIEF DESCRIPTION OF THE FIGURES

Embodiments of the subject matter are more particularly described with reference to the following drawings taken in connection with the following description.

DETAILED DESCRIPTION OF PREFERRED EMBODIMENTS

Figure 2:
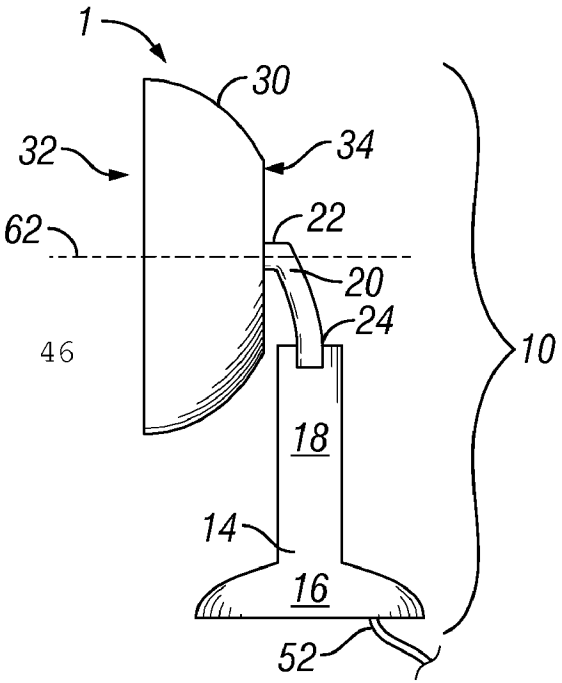
FIGS. 1A, 1B and 2 are respectively a perspective, front, and side views of an embodiment of the present subject matter.
Figure 1B:
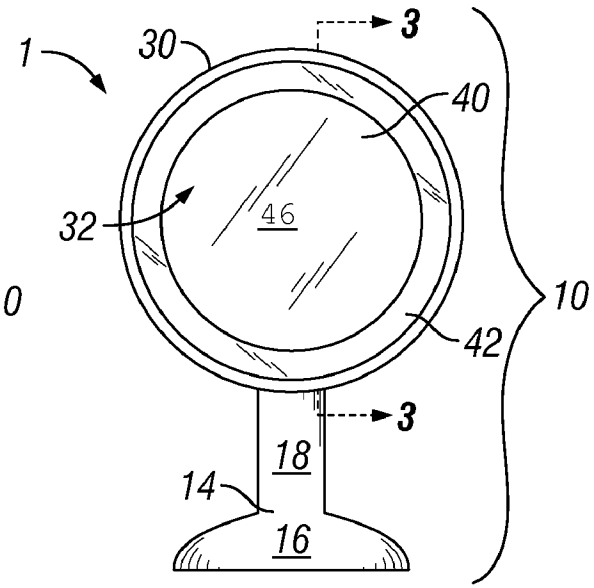
Figure 1A:
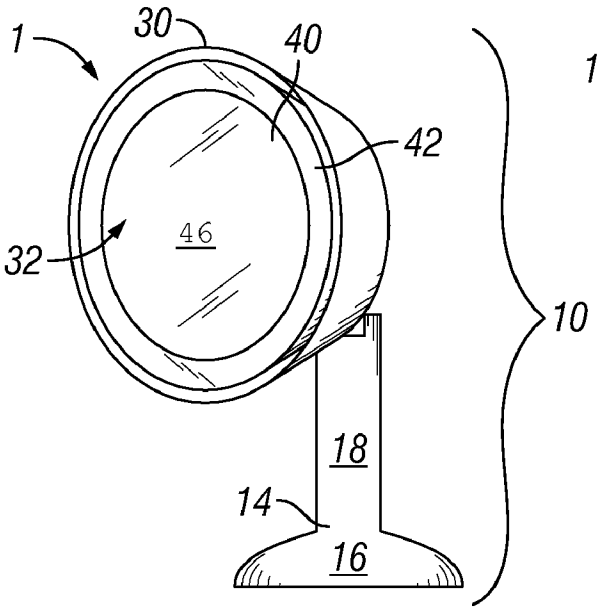
Figure 3:
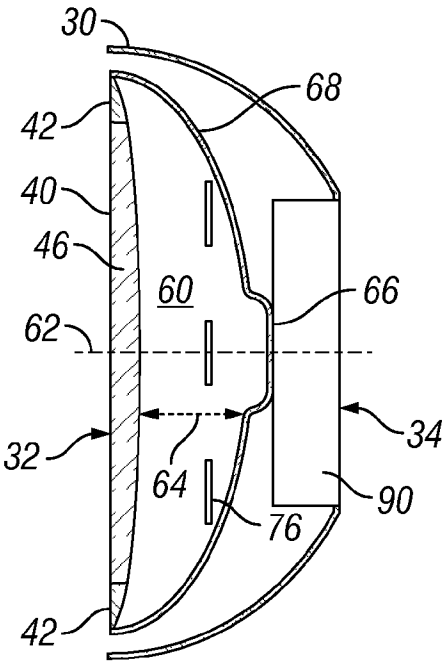
FIG. 3 is a cross-sectional view of a housing taken along lines 3-3 of FIG. 1B.

FIGS. 1A, 1B, and 2 are respectively a perspective, front and side view of an illuminated mirror 1 constructed in accordance with one embodiment of the present subject matter. FIG. 3 is a cross-sectional view taken along lines 3-3 of FIG. 1B.

Referring to FIGS. 1A, 1B, and 2, a frame 10 contains reflective and specular surfaces and subassemblies further described below. The frame 10 is mounted to a stand 14. Many different forms of stand 14 could be provided. In the present illustration, the stand 14 comprises a traditional base 16 and vertical column 18. The vertical column 18 may support a yoke 20. The yoke 20 may include first 22 and second 24 pivot mounts to which the frame 10 is gimbaled. Alternatively, the stand 14 could comprise a bonding assembly to secure the frame 10 to an art object such as a door or a counter rather than supporting the frame 10 to base 16 on a surface.

Still referring to FIGS. 1A, 1B, and 2, the frame 10 may comprise a housing 30 which encloses components further described below. For purposes of orientation, an end of the housing 30 which will likely face a user (for instance as depicted in FIG. 1B) is referred to as a front end 32. The housing 30 has a rear end 34 displaced from the front-end 32. The dimension from front end 32 to rear end 34 (i.e., a horizontal direction in FIG. 2), is referred to as the longitudinal dimension. The dimensions across the front end 32(i.e., the horizontal and vertical directions in FIG. 1B), are referred to as the transverse and vertical dimensions. The housing 30 defines longitudinal, vertical, and transversal volume which is open faced at the front end 32.

As depicted in the FIGS. 1A, 1B, and 3, a specular surface 40 is usually mounted adjacent the front end 32. A lens 42 generally circumscribes the specular surface 40. The lens 42 may be translucent or transparent. The lens 42 may be optically flat. In other words, it is not necessary for the lens 42 to provide a focusing function. The specular surface 40 and associated lens 42 may be included in a unitary plate 46. The plate 46 may be flat or contoured. The specular surface 40 may comprise a central, portion of the plate 46. The lens 42 may comprise a peripheral portion of the plate 46, as best depicted by FIGS. 1A and 1B. The outer perimeter of the plate 46 is preferably parallel to the transverse-vertical plane of a front end 32 of the housing 30, and maybe coplanar therewith, as best seen in FIG. 3. Subject thereto, the plate 46 is affixed to the reflector 60 relative to the housing 30 whereby the plate 46 is preferably suspended within the housing 30.

The housing 30 and internal assemblies depicted in FIG. 3 are discussed further below in Connection with FIGS. 7 and 9 through 11. A power cord 52 may extend through the housing 30 or to the housing 30 through the base 16 and column 18, as depicted in FIG. 2, to communicate from circuitry inside the housing 30 to an external source of power. In an alternative embodiment, further described below, a battery may be provided.

Figure 4B:
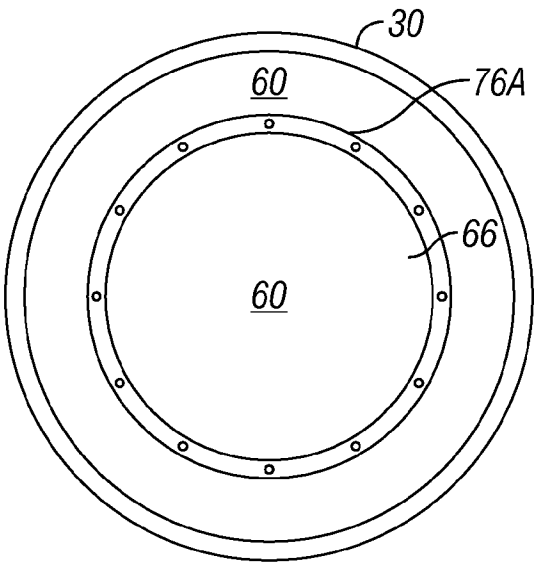
FIGS. 4A and 4B are front elevations of a reflector including alternative illumination schemes.
Figure 4A:
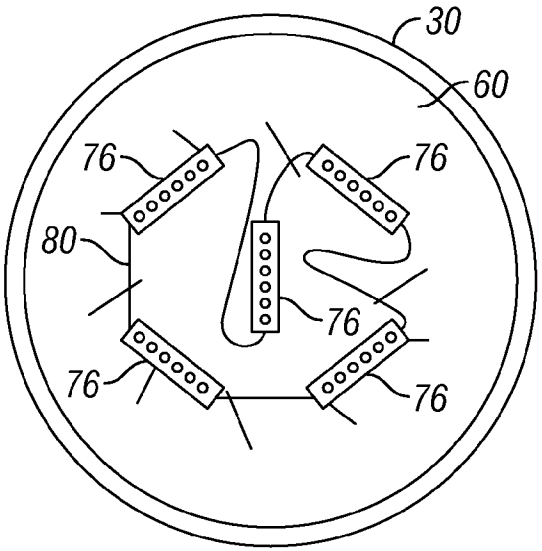

FIGS. 4A and 4B are front views of a reflector 60 positioned in the housing 30 in alternative illumination schemes. The reflector 60, the plate 46 and the housing 30 may be concentric on an axis 62 as depicted in FIG. 3. The reflector 60 is typically positioned longitudinally intermediate the front end 32 and the rear end 34. In one form, the reflector surface 60 generally defines a void or volume 64 longitudinally extending from the rear of the plate 46 to the fan 90. The volume 64 may be normal to the back of plate 46. Alternatively, the volume 64 may be conical or bowl-like.

Figure 6:
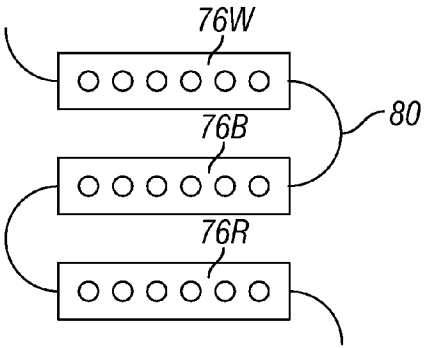
FIG. 6 is an illustration of one form of LED arrangement for providing variable light intensity and color.
Figure 7:
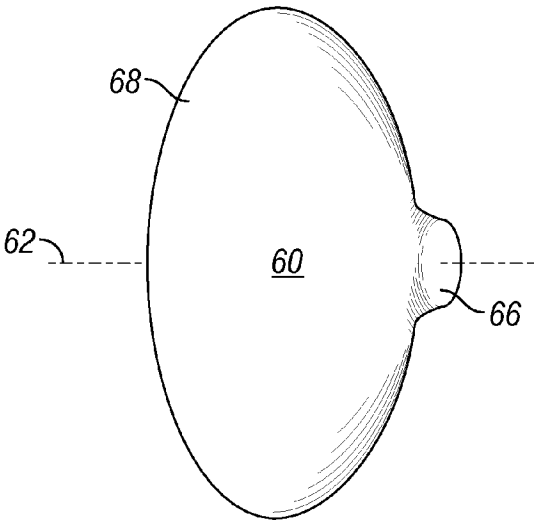
FIG. 7 is a rear elevation of a reflector.

As depicted in FIGS. 3 and 7, the reflector 60 is defined by a bowl shape with a portion 66 that may be substantially flat. In other words, the flat rear portion 66 is longitudinally displaced from and joined to the plate 46 (as best illustrated in FIG. 3) by a curved wall 68, which may define a bowl shape (best illustrated by viewing FIGS. 3 and 7 in combination). Subject thereto, volume 64 need not necessarily be of any particular shape. In many applications, simply by making the surface of the reflector 60 reflective, sufficiently efficient operation will be provided. More specifically, light from nominal sources, further described below, will provide sufficient illumination for specular surface 40 viewing while not requiring a level of illumination to generate excessive heat or require excessive power. If desired, however, the volume 64 may be formed in a particular shape. For example, the rear panel 66 and wall 68 may be unitary and comprise a parabolic reflector 60. Lamps 76, 76A depicted in FIGS. 4A and 4B and further described with respect to FIGS. 5 and 6 below, may be mounted directly to the reflector 60.

Figure 5:
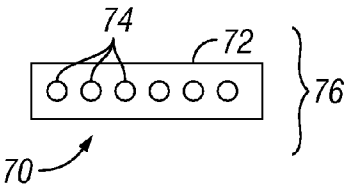
FIG. 5 is a view of one form of LED device suitable for use in the present embodiment.

FIG. 5 is a view of one form of light source 70 suitable for use in the present embodiment, although other types of light sources may also work. An efficient form of light source 70 is an LED. In the present illustration, the light source 70 comprises an LED strip device 72 comprising a plurality of individual LEDs 74. The strip device 72 allows for flexibility in design. The LED strip device 72 may be truncated to provide a particular number of LEDs 74. The illuminating device comprising the preselected number of LEDs 74 cut from the strip device 72 is referred to as the lamp 76,76A.

As seen in FIGS. 4A, 4B and 5, and given further context by FIG. 3 a plurality of lamps 76, 76A are mounted in a preselected pattern, adjacent of the reflector 60(preferably within the volume 64 as depicted in FIG. 3). In the present illustration, the lamps 76, 76A are equiangularly displaced within a circular pattern on the rear panel 66. The lamps 76, 76A may be secured to the reflector 60 in a number of different ways. In the present illustration, the lamps 72 are secured to the reflector 60 by an adhesive. In one alternative, the lamps 76, 76A may be secured by fasteners (not shown). In another form, a holder (not shown) may be secured to the reflector 60, and each lamp 76, 76A may be snapped into or out of the holder. The lamps 76, 76A may be connected so that particular LEDs 74 within each lamp 76, 76A may be illuminated independently. The numbers of LEDs 74 that are illuminated may be varied to adjust the level of illumination. Also, lamps 76, 76A on one portion of the reflector 60 may be lit while lamps 76, 76A on another portion of the reflector 60 are deenergized. This arrangement will provide uneven illumination when it is desired to provide emphasis on one portion of an object to be viewed in the mirror 40.

Generally, the lamps 76 are preferably connected in parallel by a conductor 80. The conductor 80 may be connected to a transformer (further described with respect to FIG. 10 below) or a battery (discussed further below with respect to FIG. 12). FIG. 6 is an illustration of one form of LED arrangement for providing variable light intensity and color. In this illustration, lamps 76W, 76R and 76B are utilized. The lamps 76W are white. In the present context, "white" refers to a range of spectral distributions. It is not necessary to provide a perfectly balanced R-G-B light source, i.e., a "pure" white source. The lamps 76R may be red or have a substantial red component. The lamps 76B may be blue or have a substantial blue component. Selected combinations of the lamps 76W, 76R and 76B are illuminated in order to provide a selectable "temperature" of light to illuminate the user. Generally white tones approximate sunlight. Red tones simulate candlelight, and blue tones simulate fluorescent lighting. Other combinations of colors could be provided to produce other effects.

Figure 8A:
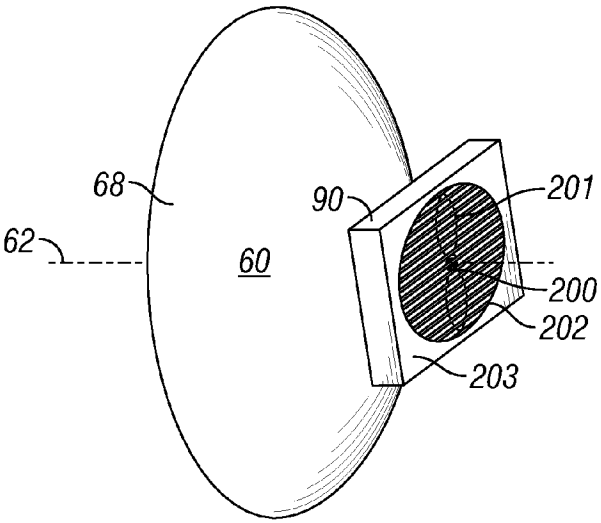
FIGS. 8A and 8B are a perspective and rear view of a cooling fan mounted to a rear surface of a reflector of FIG. 7 in one embodiment.
Figure 9:
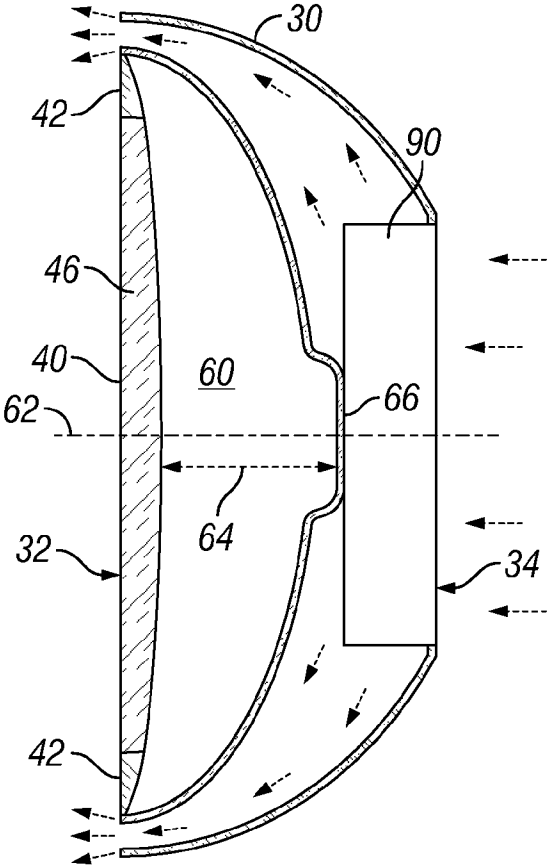
FIG. 9 is a cross-sectional illustration of the mirror of FIG. 1B illustrating airflow.
Figure 8B:
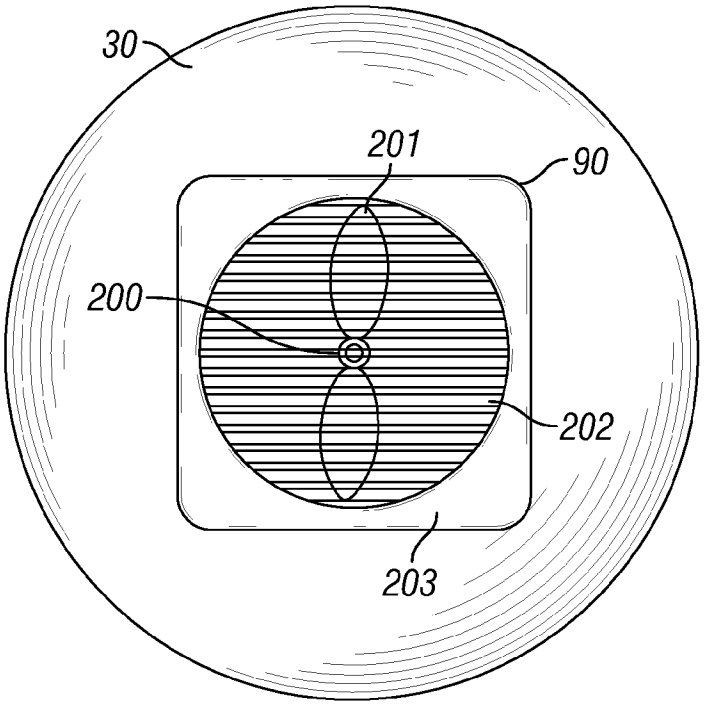

Regarding fan 90 placement: FIG. 7 is a rear view of the reflector 60; FIG. 8A is a perspective illustration of a cooling fan 90 mounted to a rear panel 66 of a reflector 60 in one embodiment; and, FIG. 8B is a rear view of the reflector 60 and fan 90 assembly of FIG. 8A. FIGS. 3 and 9 are cross-sectional illustrations of FIGS. 8A and 8B. FIGS. 3 and FIG. 9 depict the fan 90 and reflector 60 assembly, as such may be positioned within the housing 30. The fan 90 may either be mounted flush to the flat rear portion 66 of the reflector 60, as depicted in FIGS. 8A and 8B, or alternatively maybe spaced therefrom.

Various types of fans, motors, blowers, or any other type of air-moving device, may be provided to the mirror 1. Typically, fans (or other air-moving devices) having radial airflow at an input or output thereof and axial airflow at the other end of the fan, as depicted in FIG. 9, are preferable. The desired airflow and the type of fan used are factors in whether to mount the fan 90 flush with the rear panel 66 or spaced therefrom.

As seen in FIGS. 8A and 8B, the fan 90 may conveniently comprise a brushless DC motor 200 for driving vanes 201 while surrounded by a circular cowling 202 within a square housing 203. This sort of fan is commonly used for cooling computers. Fans 90 are made in a number of standard sizes. Sizes are commonly denoted in terms of the length of one side of the square housing 203. Common sizes are 1 or 3 inches. Larger cooling fans are also made, for instance a preferable fan 90 size is 4.75" (120 mm). However, in many applications, a 3 inch fan will be a desired size. Subject thereto, the size of the fan 90 will depend on the size of the mirror 1 or the desired air discharge rate, or both.

Figure 10:
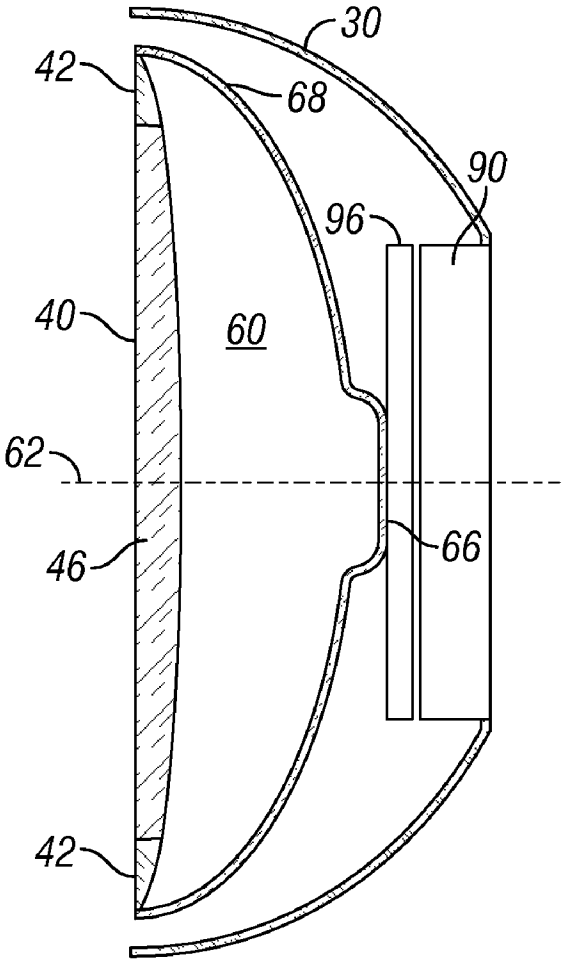
FIG. 10 is an illustration of a further embodiment comprising a cooling device used in conjunction with the cooling fan.

FIG. 10 is an illustration of a further embodiment comprising a cooling device 96 used in conjunction with the cooling fan 90. In the present illustration, the cooling device 96 is mounted adjacent the fan 90, and the fan 90 blows air on the cooling device 96. The cooling device 96 could comprise a Peltier effect device which removes heat when energized. In other words, the cooling device 96 cools air passing over it (air flow would typically be similar to that depicted in FIG. 9 in such an embodiment). In another form, a component comprising a miniaturized refrigeration device may be utilized. One such device is the capillary pumped loop. Other cooling devices may be used.

Figure 11:
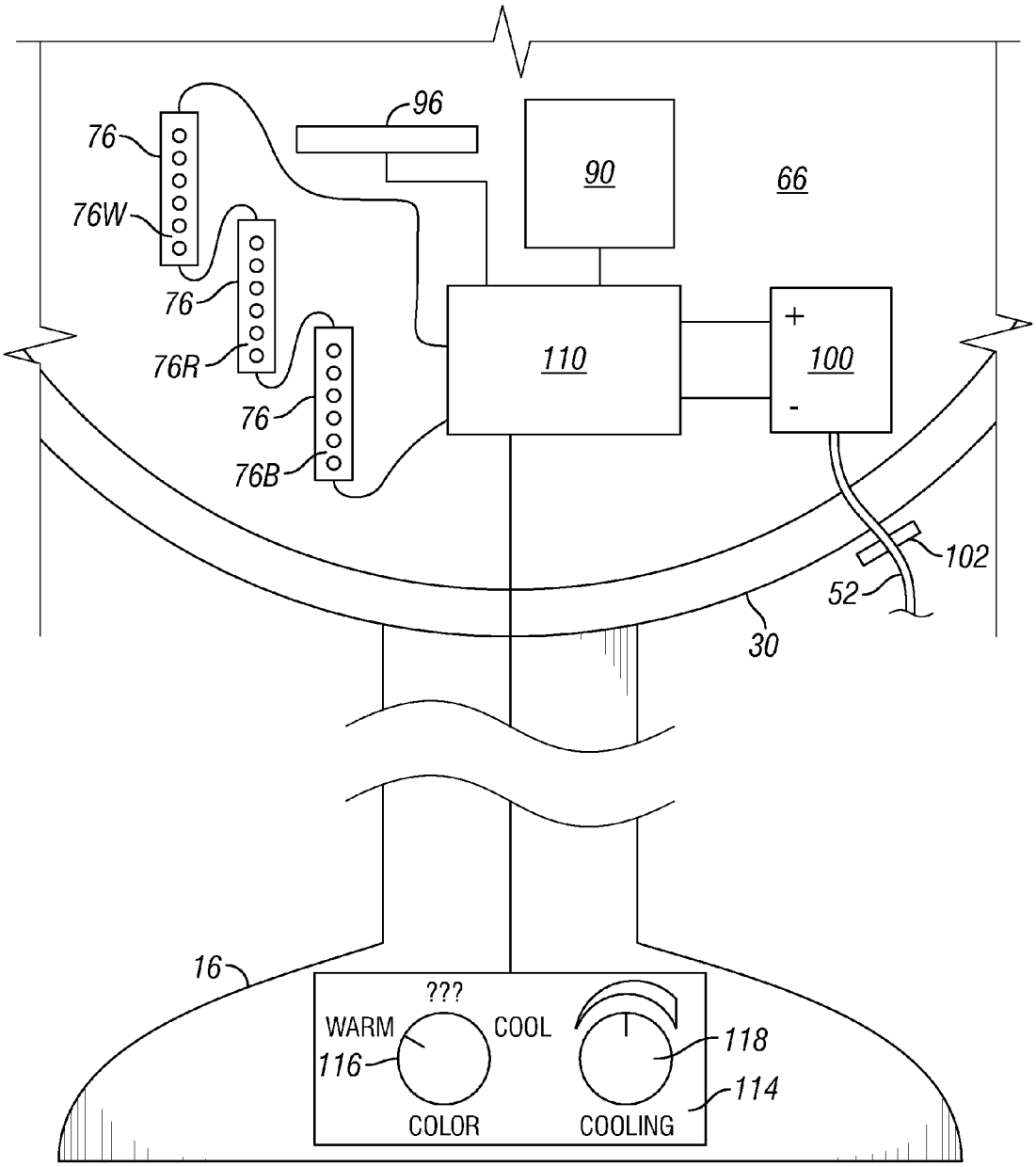
FIG. 11 is an illustration of a control circuit.

FIG. 11 is circuit diagram of the present embodiment. AC input power is provided via the line cord 52 to a power supply circuit 100. The power supply circuit 100 converts the incoming domestic AC voltage to a low direct current voltage suitable for operating the fan 90 and the lamps 76, and optionally the cooling unit 96. An example of the desired voltage level is 12 volts. An on-off switch 102 may be mounted in the housing 30. The power supply 100 is coupled to a control circuit 110.

Figure 12:
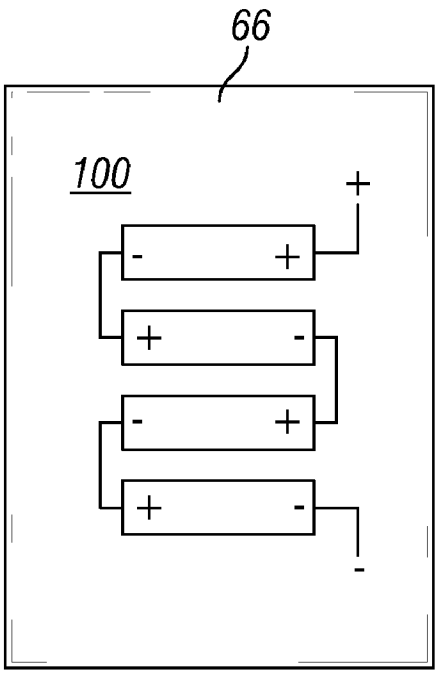
FIG. 12 is an illustration of a battery-operated embodiment.

As shown toward the bottom of FIG. 11, a user interface 114 is provided coupled to the control circuit 110 the user interface 114 may be built into a base 16 of the lamp assembly 1, may be built into the frame 10 or may be mounted on the housing 30. Alternatively, the user interface 114 could comprise a remote control, in which case the control circuit 110 would comprise a receiver. Controls on the user interface 114 may comprise analog or other switches capable of registering a selection. A first control 116 comprises a color selector. The control circuit 110 can be comprise a look up table in order to map a color selection Into a preselected set of lamps 76W, 76R and 76B. A second control 118 is coupled to the control circuit 110 to select a desired operating status for the cooling device 96. In addition to selecting an on-off status are, a level of cooling may also be selected. FIG. 12 is an illustration of a battery-operated embodiment. In the present embodiment, the power supply 100 comprises a battery pack. The battery pack may include conventional cells, e.g. AA batteries 120. Alternatively, the power supply may utilize rechargeable batteries such as NiCad batteries.

The user may select a lighting scheme and a cooling scheme and enter selections via user interface 114. The frame 10 and or housing 30 may be tilted so as to enable the most comfortable airflow. The user may have an improved experience in view of the selection and lighting and cooling.

The previous description of some aspects is provided to enable any person skilled in the art to make or use the present subject matter. Various modifications to these aspects will be readily apparent to those skilled in the art, and the generic principles defined herein may be applied to other aspects without departing from the spirit or scope of the present subject matter. For example, one or more elements can be rearranged and/or combined, or additional elements may be added. Thus, the present subject matter is not intended to be limited to the aspects shown herein but is to be accorded the widest scope consistent with the principles and novel features disclosed herein.

We claim:

1. A mirror, comprising:

a housing having a circular and open-faced front end and a rear end displaced from the front end in a longitudinal dimension, so that the housing defines a volume in the transverse, vertical, and longitudinal dimensions;

a circular plate with at least one specular surface that is mounted within the volume of the housing adjacent to the front end thereof so that (1) the plate is substantially parallel with a transverse-vertical plane of the front end of the housing and (2) the plate is suspended therein said open-face of the housing so that the space between the periphery of said plate and the housing remains open;

a power source; and, at least one fan, situated behind said specular surface within the volume of said housing and mechanically connected to the rear-end of said housing, said fan configured to forcibly discharge air from the opening between the housing and the periphery of said plate;

a reflector that is mechanically connected to the periphery of the plate and that longitudinally extends therefrom said periphery in a conical manner to a rear end which is mechanically connected to the fan so as to result in said suspension of said plate within the housing.

2. The mirror of claim 1 wherein said forcible discharge is longitudinally directed from around the periphery of said specular surface.

3. The mirror of claim 1 further comprising an illumination system behind said plate.

4. The mirror of claim 3 wherein said illumination system comprises:

a transmissive surface circumscribing said specular surface;

the reflector; and, at least one selectively illuminable LED lamp positioned on said reflector whereby light is emitted via said transmissible surface when said LED lamp is illuminated.

5. The mirror of claim 1 further comprising a cooling unit that is configured to cool said air.

6. The mirror of claim 5 wherein said cooling unit is from the group comprising:

a Peltier effect device, a refrigeration unit, and, a capillary pumped loop.

7. The mirror of claim 1 wherein said power source is at least one battery.

8. The mirror of claim 1 wherein said power source is a power cord associated with an A.C. output.

9. The mirror of claim 1 wherein said fan comprises:

a brushless DC motor; and, at least one vane, configured to be driven by said motor.

10. A mirror comprising:

a housing with an open-ended front end and a rear end;

a circular plate with at least one planar specular surface and that is suspended within the housing at the front end so that an opening is defined between the periphery of the plate and the front end of the housing;

said plate being suspended by means of a bowl-shaped reflector with a rim that is coupled to the periphery of the plate and a base that is mechanically connected the rear of the housing;

a fan that is positioned intermediate the rear of the housing and the reflector, wherein said fan is concentric with said reflector and wherein said fan is configured to selectively force air through the opening between the periphery of said plate and said front-end of the housing; and, a power supply with an on-off switch for selectively forcing said air.

11. The mirror of claim 10 wherein said reflector is positioned to guide the air to said opening so that said air is discharge longitudinally at the periphery of said plate.

12. The mirror of claim 11 further comprising a cooling means that is configured to cool said air.

13. The mirror of claim 10 wherein:

said specular surface is circumscribed by a transmissive surface of said plate, wherein said transmissive surface is configured to be selectively illuminable, said mirror further comprising an illumination means behind said specular surface; and, said discharge occurs longitudinally at the periphery of said plate.

14. The mirror of claim 10 further comprising a cooling means that is configured to cool said air.

15. The mirror of claim 10 wherein said power source is at least one battery.

16. A mirror comprising:

a housing with an open front end and a rear end;

a bowl-shaped reflector with a rim and a basin that is mechanically connected to the rear end of the housing;

a plate mounted to the rim of the bowl-shaped reflector so that the plate is suspended within the open front end of the housing, wherein said plate features a specular surface;

a fan that is mounted between the reflector and the rear end of the housing and that is operationally configured to blow air across the reflector so that air is discharged at the open end of the housing around the periphery of the plate; and, a power source for said fan.

17. The mirror of claim 16 wherein said plate comprises a transmissive surface which is configured to be selectively illuminable, said mirror further comprising an illumination means behind the specular surface that is powered by said power source.

18. The mirror of claim 17 further comprising a cooling means that is configured to cool said air.

* * * * *